United States Patent [19]

Braziel

[11] 4,396,162

[45] Aug. 2, 1983

[54] DUAL PACKAGE WINDER WITH INDIVIDUAL BACK-OFF CONTROL OF SEPARATE PACKAGE BUILDERS

[75] Inventor: Jeff B. Braziel, Travelers Rest, S.C.

[73] Assignee: Owens-Corning Fiberglas Corporation, Toledo, Ohio

[21] Appl. No.: 350,491

[22] Filed: Feb. 19, 1982

Related U.S. Application Data

[63] Continuation of Ser. No. 205,060, Nov. 7, 1980, abandoned.

[51] Int. Cl.[3] ..... B65H 54/08; B65H 54/20; B65H 54/28

[52] U.S. Cl. ..... 242/18 G; 242/35.5 R; 242/43 R

[58] Field of Search ..... 242/18 G, 18 R, 35.5 R, 242/43 R, 18 B, 18 CS; 65/10.1

[56] References Cited

U.S. PATENT DOCUMENTS

| | | | |
|---|---|---|---|
| 3,838,827 | 10/1974 | Klink et al. | 242/18 G |
| 3,897,021 | 7/1975 | Shape | 242/18 G |
| 4,061,285 | 12/1977 | Powers, Jr. | 242/18 G X |
| 4,076,181 | 2/1978 | Coggin, Jr. | 242/18 G |
| 4,146,376 | 3/1979 | Beckman et al. | 242/18 G X |
| 4,294,416 | 10/1981 | Beckman et al. | 242/18 G |

*Primary Examiner*—Stanley N. Gilreath

*Attorney, Agent, or Firm*—Ronald C. Hudgens; Philip R. Cloutier; Paul J. Rose

[57] ABSTRACT

An apparatus for simultaneously winding two strands of glass filaments from a filament forming bushing on a single winding collet and including two package builders each with its own package size sensing means, carriage, and back-off motor whereby two different-sized packages can be properly wound in case of temperature imbalance in the bushing.

4 Claims, 9 Drawing Figures

DUAL PACKAGE WINDER WITH INDIVIDUAL BACK-OFF CONTROL OF SEPARATE PACKAGE BUILDERS

This is a continuation of application Ser. No. 205,060, filed Nov. 7, 1980, now abandoned.

TECHNICAL FIELD

This invention relates generally to filament or strand winding apparatus and more particularly to dual package winders for separately winding two strands of glass filaments being continuously drawn from a bushing supplied with molten glass.

BACKGROUND ART

U.S. Pat. No. 3,897,021 discloses a dual package winder wherein two strands of glass filaments drawn from a bushing are wound into separate cylindrical packages axially aligned on a single winding collet. A package builder of the winder includes two axially aligned cylindrical or barrel cams fixedly mounted on a rotatable shaft and each driving a strand guide member back and forth axially along a respective one of the packages being wound. Each strand guide member is mounted on one end of a flat spring member attached at the other end to a slide block mounted in a longitudinal slot in a tubular housing for the barrel cams and pivotally connected to a cam follower disposed in a groove of the respective barrel cam. The cam housing has two switches mounted thereon respectively midway of the barrel cams, and each spring member carries a switch actuating means on the side opposite the strand guide member. The package builder is mounted on a motor driven carriage operable to move the builder toward or away from the winding collet.

The glass filaments vary in diameter if the temperature of the bushing bottom becomes non-uniform. Glass from relatively cooler orifices is attenuated less, resulting in larger filaments. One of the packages being wound may thus become larger than the other when bushing temperature imbalances occur. The larger package will be the first to bend the flat spring member associated with its respective strand guide member sufficiently for the switch actuating means thereon to close the respective switch on the cam housing as it passes by and thereby energize the carriage motor for a controlled time interval. The carriage is then moved in a direction to move the builder a certain distance away from the packages being wound. If there is much difference in the sizes of the packages, the strand guide member for the smaller package will be moved too far away and cause the smaller package to be wound too loosely into a package with flared ends. Such flared-end packages are not within customer acceptance standards and must be scrapped.

DISCLOSURE OF INVENTION

In accordance with the invention, a separate package builder is provided for each of the two packages. The two barrel cams are rotated at the same speed, but each package builder is mounted on its own carriage and controlled independently of the other with respect to its location from the winding collet. Therefore, if the temperature across the bottom of the bushing becomes non-uniform and one package being wound becomes larger than the other because of larger filaments, each of the strand guide members will be maintained in proper winding relationship with its own package. Two different-sized packages will result, but each will be properly wound and usable.

BRIEF DESCRIPTION OF THE DRAWINGS

This invention is described hereinafter in detail with respect to the accompanying drawings in which.

BEST MODE OF CARRYING OUT THE INVENTION

Figures 1, 2, 3:
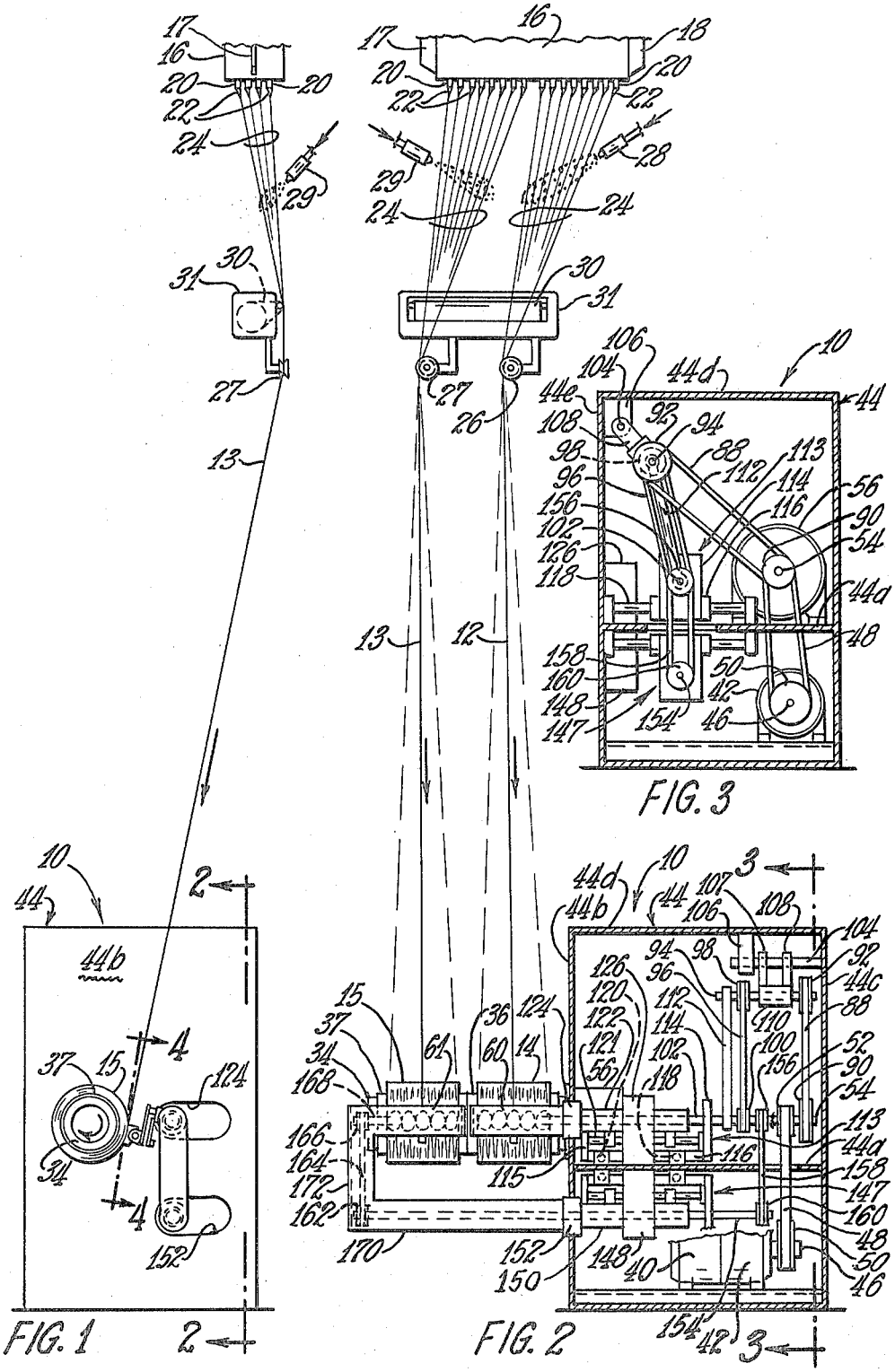
FIG. 1 is a front elevational view of a winding apparatus constructed in accordance with the invention, along with associated fiber forming means.
FIG. 2 is a side elevational view of the apparatus of FIG. 1, taken partially in section generally along the line 2—2 of FIG. 1.
FIG. 3 is a rear elevational view of the winding apparatus of FIG. 1, taken in section generally along the line 3—3 of FIG. 2.

With respect to the drawings, a winding apparatus 10 constructed in accordance with the invention is shown in FIGS. 1–3, for simultaneously winding two glass strands 12 and 13 respectively into two separate packages 14 and 15. The strands 12 and 13 are drawn from an electrically heated stream feeder or bushing 16 supplied with molten glass from a furnace (not shown) and having a pair of electrical terminals 17 and 18 connectible to a source of electrical power for keeping the molten glass at proper fiber forming temperatures and viscosities. In the embodiment shown, a bottom wall of the bushing 16 is provided with a plurality of bushing tips or tubular members 20 for delivering individual streams 22 of molten glass. Individual continuous glass filaments 24 are drawn respectively from the streams 22. The filaments 24 are gathered into the two strands 12 and 13 respectively at a pair of gathering shoes 26 and 27 located beneath the bushing 16. Nozzles 28 and 29 are provided for spraying the filaments 24 with water before they are drawn over a sizing applicator belt 30 rotatably driven in a liquid sizing container 31 on which the gathering shoes 26 and 27 are mounted.

The winding apparatus 10 is located below the gathering shoes 26 and 27 and winds the strands 12 and 13 into the separate packages 14 and 15 on a single winding collet 34 having a pair of tubular cores 36 and 37 mounted thereon. The collet 34 is provided with a variable-speed driving means in order that the rotational speed of the collet can be reduced as the size of the packages 14 and 15 increases. This enables the linear speed of the strands 12 and 13 to remain substantially constant as the strands are advanced toward the collet, even though the package size increases. In the embodiment shown, a constant-speed electric motor 40 and an associated magnetic clutch 42 are provided in a lower compartment of a housing 44 of the winding apparatus 10. The housing 44 has a horizontal partition or mounting platform 44*a*. The motor 40 directly drives a rotor within the clutch 42, which has an output shaft 46. A non-slipping belt 48 operatively connects a pulley 50 on the output shaft 46 with a pulley 52 on a drive shaft 54 for the winding collet 34. The drive shaft 54 is disposed in an upper compartment of the housing 44 coaxially of the winding collet 34 and is rotatably supported by a bearing mounting assembly 56 located on the upper side of the mounting platform 44*a* adjacent a front wall 44*b* of the housing 44.

Magnetic forces generated within the clutch 42 transfer rotational energy of the motor driven rotor of the clutch to the output shaft 46. Changes in the flux density (magnetic forces) within the clutch 42 vary the amount of rotational energy transferred from the rotor to the output shaft 46 and to the winding collet 34. A greater flux density effects transfer of greater rotational energy from the rotor to the output shaft 46 and increases the speed of the winding collet 34.

The winding collet 34 is programmed to run for a predetermined time, with curvilinearly decreasing speed, the time being the amount required to completely wind the packages 14 and 15 so that they respectively contain a predetermined length of the glass filament strands 12 and 13. This may be accomplished with a control system for the magnetic clutch 42, such as that disclosed in U.S. Pat. No. 4,146,376, issued Mar. 27, 1979.

Figures 4, 5, 6, 7, 8:
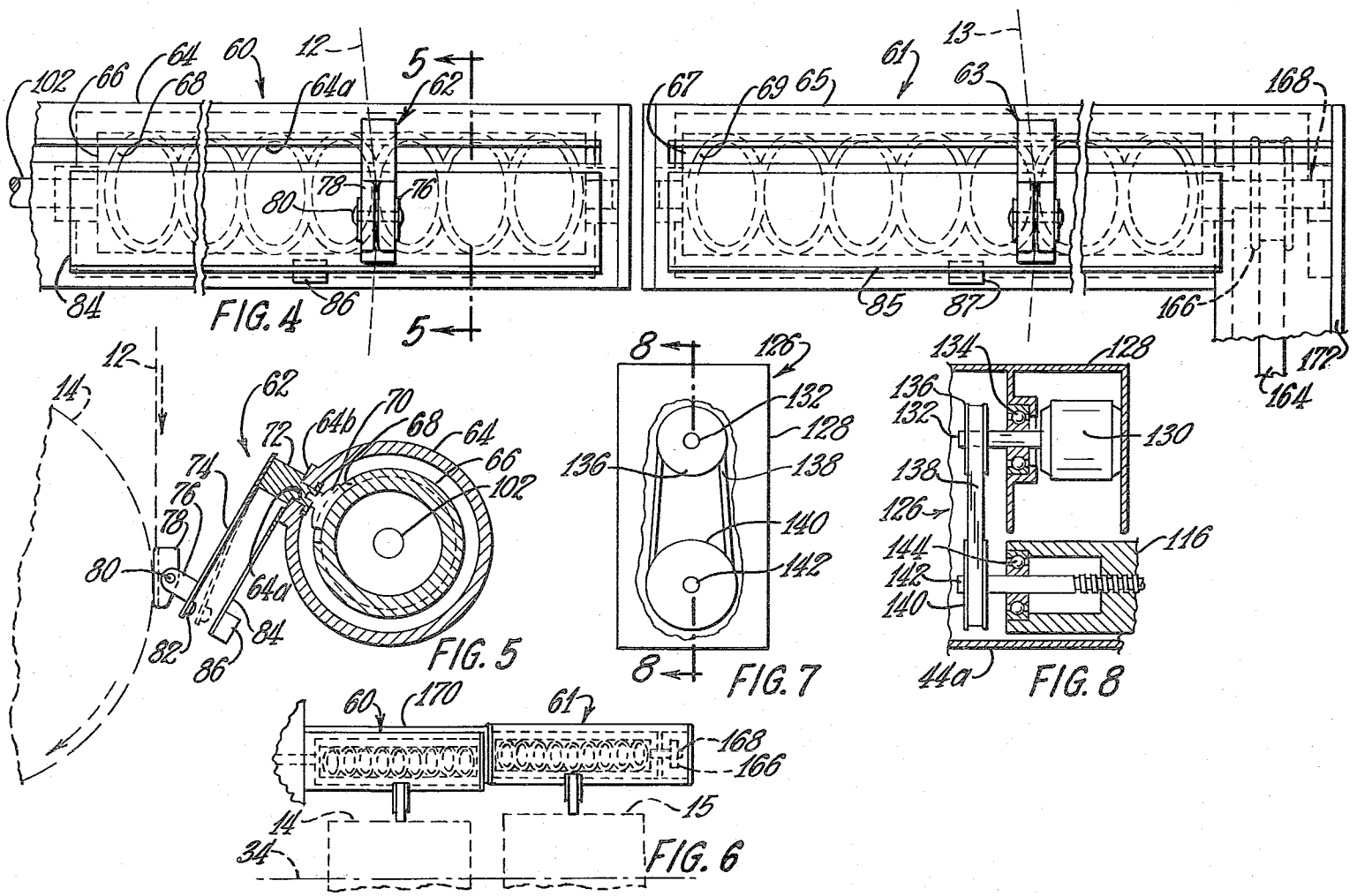
FIG. 4 is an elevational view of package builders of the winding apparatus, taken in the direction of arrows 4—4 of FIG. 1.
FIG. 5 is a sectional view of one of the package builders, taken generally along the line 5—5 of FIG. 4.
FIG. 6 is a plan view of the package builders of the winding apparatus of FIG. 1.
FIG. 7 is an elevational view, partially broken away, of a carriage driving means for one of the package builders of the winding apparatus of FIG. 1.
FIG. 8 is a fragmentary sectional view taken generally along the line 8—8 of FIG. 7.

Each of the strands 12 and 13 is traversed back and forth, along the respective package 14 or 15 being wound, by a separately mounted package builder or strand traversing apparatus having its own back-off control. As best shown in FIGS. 2 and 4, a package builder 60 is provided for traversing the strand 12 and a package builder 61 is provided for traversing the strand 13. The builders 60 and 61 are separately mounted and driven, but are otherwise substantially identical.

The builders 60 and 61 respectively include identical strand traversing assemblies 62 and 63, slotted tubular housings 64 and 65, and cylindrical or barrel cams 66 and 67 rotatably mounted in the tubular housings 64 and 65, which are movable toward and away from the winding collet 34. Each of the barrel cams 66 and 67 is provided with a continuous groove which consists of a right-hand generally helical groove and a left-hand generally helical groove connected to each other adjacent opposite ends of the cam, as shown most clearly in FIG. 4. The cam 66 has such a continuous groove 68 and the cam 67 has such a continuous groove 69.

The strand traversing assembly 62 is shown most clearly in FIG. 5 and includes a cam follower 70 disposed in the groove 68 of the cam 66, and slide block 72 pivotally mounted on the cam follower 70 and reciprocably mounted in a slot 64*a* of the tubular housing, an elongated flat spring 74 mounted adjacent one end on the slide block 72, a generally U-shaped bracket 76 mounted on the spring 74 adjacent the other end on the side thereof facing the collet 34, a slotted strand guide member 78 mounted on the bracket 76 by a pin 80, and a switch actuating member 82 on the same end portion of the spring 74 as the bracket 76 but on the opposite side thereof.

The tubular housing 64 is enlarged on the outside adjacent the slot 64*a* to provide a flat surface 64*b* for the block 72 to slide on. An elongated flat support plate 84 is mounted on the surface 64*b* below the slide block 72. Midway of the cam 66 a proximity switch 86 is mounted on the plate 84 on the side thereof facing the tubular housing 64 and generally in alignment with the switch actuating member 82 at the time the strand traversing assembly 62 is passing by in its horizontal movement back and forth along the collet 34. The tubular housing 65 has a plate 85 and a proximity switch 87 similar respectively to the plate 84 and proximity switch 86.

A belt 88 (FIGS. 2 and 3) operatively connects a pulley 90 on the collet drive shaft 54 with a pulley 92 on an idler shaft 94. A belt 96 operatively connects a pulley 98 on the idler shaft 94 with a pulley 100 on a driveshaft 102 for the barrel cam 66 of the package builder 60. The idler shaft 94 is suspended for pivotal movement about a stationary support shaft 104 secured at one end to a rear wall 44*c* of the housing 44 and mounted at the other end in a bracket 106 secured to a top wall 44*d* and a side wall 44*e* of the housing 44. A pair of links 107 and 108 pivotally mounted on the shaft 104 support a bearing box 110 for the shaft 94. A rigid link 112 interconnects the shafts 94 and 102 to maintain the distance therebetween constant.

The shaft 102 is mounted for horizontal movement transversely thereof by means of a carriage 113 which includes a pair of opposite vertical carriage plates 114 and 115 secured to a carriage block or horizontal carriage plate 116. The carriage block 116 is reciprocably mounted on a pair of guide shafts 118 and 120 suitably mounted above the mounting platform 44*a*. The carriage plates 114 and 115 are joined by a bracing rod 121. A bearing housing 122 for the cam drive shaft 102 is suitably supported on the rod 121 and the carriage plate 115. The shaft 102 extends through the carriage plate 114. An oblong sleeve 124 in the front wall 44*b* of the housing shields an end of the bearing housing 122 and an end of the tubular housing 64. As the carriage 113 moves along the shafts 118 and 129, the shaft 102, bearing housing 122, and tubular housing 64 move longitudinally of the oblong sleeve 124. A drive mechanism 126 is provided for moving the carriage 113 along the guide shafts 118 and 120.

The drive mechanism 126 is best shown in FIGS. 7 and 8 and includes a housing 128 having a motor 130 mounted therein. The motor 130 is energizable by the proximity switch 86. An output shaft 132 of the motor 130 is suitably supported by a bearing 134 and drives a pulley 136 mounted thereon. A belt 138 operatively connects the pulley 136 with a pulley 140 mounted on a shaft 142 threaded into the carriage block 116. A bearing 144 mounted in the carriage block 116 helps support the shaft 142.

A carriage 147 (FIGS. 2 and 3) identical to the carriage 113 but inverted with respect thereto is mounted on the bottom of the mounting platform 44*a* and is driven along guide shafts identical to the guide shafts 118 and 120 by a drive mechanism 148 identical to the drive mechanism 126. The carriage 147 carries a bearing housing 150 identical to the bearing housing 122 and movable along an oblong sleeve 152 in the front wall 44*b* identical to the sleeve 124. The housing 150 carries a shaft 154 driven from the shaft 102 by means of a by means of a pulley 156 on the shaft 102, a belt 158, and a pulley 160 on the shaft 154. The shaft 154 drives the barrel cam 67 by means of a pulley 162 on the shaft 154, a belt 164, and a pulley 166 on a drive shaft 168 for the barrel cam. A housing 170 surrounds the portion of the shaft 154 outside the housing 44, and a housing 172 surrounds the belt 164 and supports the tubular housing 65 for the barrel cam 67.

The belts 88 and 158 may be oversize and provided with suitable take-up mechanism (not shown).

FIG. 6 illustrates a condition which occurs when a temperature imbalance occurs in the bushing 16 and the filaments in the strand 13 become larger in diameter than the filaments in the strand 12. Because the builders 60 and 61 are independent of each other, the builder 61 has moved farther away from the collet 34 in response to the larger size of the package 15, while the builder 60 has remained in good operative relationship with the smaller package 14. The final result is two packages 14 and 15 of different sizes, but with both packages being properly wound and usable.

Figure 9:
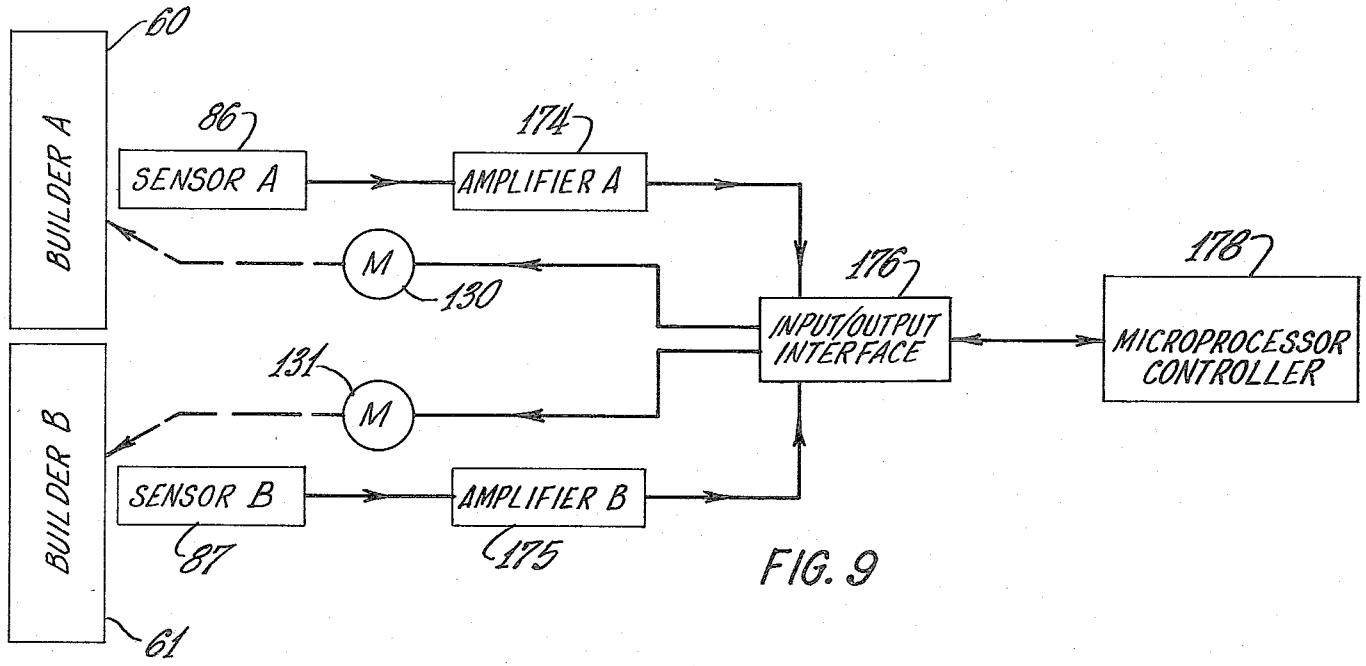
FIG. 9 is a schematic diagram of the control logic flow for the two package builders of the winding apparatus of FIG. 1.

FIG. 9 shows a diagram of the dual builder control logic flow. Essentially the dual builder sensor system operates as two independent systems. That is, the dual system may be considered as consisting of Builder System A and Builder System B. If Sensor A (switch 86) trips, a signal is sent through Amplifier A (an amplifier 174) and an input/output interface 176 to a microprocessor controller 178. The microprocessor controller 178 receives the amplified signal as an input, executes a programmed delay time, and energizes the back-off motor 130 for the carriage 113 for a programmed amount of time. This sequence will occur with no interaction with Builder System B.

If Sensor B (switch 87) trips, a signal is sent through Amplifier B (an amplifier 175) and the input/output interface 176 to the microprocessor controller 178. The microprocessor controller 178 receives the amplified signal as an input, executes a programmed delay time, and energizes a back-off motor 131 for the carriage 147 for a programmed amount of time. This sequence will occur with no interaction with Builder System A.

This method of control allows both systems to operate independently, but if the package build rates are the same, they may operate simultaneously.

Various modifications may be made in the structure shown and described without departing from the spirit and scope of the invention.

I claim:

1. A winding apparatus for simultaneously winding two strands of glass filaments from a filament forming bushing supplied with molten glass respectively into separate packages, the winding apparatus comprising a rotatably mounted winding collet upon which the two strands are wound into separate packages, means for rotating the winding collet, two package builders associated with the winding collet and spaced from each other therealong, each package builder including means for traversing a respective one of the strands back and forth along the winding collet and sensing means for sensing increases in the size of a respective one of the packages being wound, and means for moving the package builders independently of each other away from the winding collet in accordance with sensed increases in size of the respective packages.

2. A winding apparatus as claimed in claim 1 wherein each package builder includes a rotatably mounted barrel cam and a strand traversing assembly driven thereby, and including means for rotatably driving each of said barrel cams, each barrel cam being operatively connected to the cam driving means at an end thereof remote from the other barrel cam.

3. A winding apparatus as claimed in claim 1 wherein the means for independently moving the package builders includes two reciprocably mounted carriages each having a respective one of the package builders mounted thereon for movement toward and away from the winding collet, and two drive mechanisms respectively for the carriages, each drive mechanism including a motor energizable by the sensing means of its respective package builder.

4. A winding apparatus as claimed in claim 3 including a microprocessor controller for receiving signals respectively from the sensing means and energizing the motors of the carriage drive mechanisms respectively in response to the signals.

* * * * *